US008069887B2

(12) United States Patent
Dirnberger et al.

(10) Patent No.: US 8,069,887 B2
(45) Date of Patent: Dec. 6, 2011

(54) ICE FLAP DEVICE FOR A REFRIGERATOR

(75) Inventors: Albert Dirnberger, Neunburg v.W. (DE); Georg Spiessl, Altendorf (DE)

(73) Assignee: emz-Hanauer GmbH & Co. KGaA (DE)

( * ) Notice: Subject to any disclaimer, the term of this patent is extended or adjusted under 35 U.S.C. 154(b) by 423 days.

(21) Appl. No.: 12/401,665

(22) Filed: Mar. 11, 2009

(65) Prior Publication Data

US 2010/0089492 A1 Apr. 15, 2010

(30) Foreign Application Priority Data

Mar. 12, 2008 (DE) ..... 10 2008 013 750

(51) Int. Cl.
*B65B 1/04* (2006.01)

(52) U.S. Cl. ..... 141/362; 141/205; 141/351; 141/360; 62/389; 222/63; 222/146.6

(58) Field of Classification Search ..... 141/192, 141/205, 351, 360, 362; 62/389; 222/63, 222/146.6

See application file for complete search history.

(56) References Cited

U.S. PATENT DOCUMENTS 3,211,388 A 10/1965 Gartner
3,406,871 A 10/1968 Hoenisch
3,548,444 A * 12/1970 Callahan et al. ..... 16/78
3,640,088 A * 2/1972 Jacobus et al. ..... 62/320
3,789,620 A * 2/1974 Benasutti et al. ..... 62/344
3,942,334 A * 3/1976 Pink ..... 62/266
4,069,545 A * 1/1978 Holet et al. ..... 16/49
4,090,641 A * 5/1978 Lindenschmidt ..... 222/504
4,441,337 A * 4/1984 Kantor ..... 62/499
4,462,437 A * 7/1984 Prada ..... 141/360
4,679,715 A * 7/1987 Hovinga ..... 222/517
4,901,396 A * 2/1990 Tatematsu et al. ..... 16/76
5,077,985 A * 1/1992 Buchser et al. ..... 62/344
5,139,183 A * 8/1992 Buchser et al. ..... 222/547
6,135,173 A * 10/2000 Lee et al. ..... 141/361
6,533,003 B1 * 3/2003 Jacobus et al. ..... 141/360
7,302,809 B2 * 12/2007 Park ..... 62/344
7,316,121 B2 * 1/2008 Lee et al. ..... 62/344
7,340,914 B2 * 3/2008 Bowen et al. ..... 62/389
7,383,689 B2 * 6/2008 Lee et al. ..... 62/98
7,418,830 B2 * 9/2008 Bowen et al. ..... 62/344
7,418,831 B2 * 9/2008 Bowen et al. ..... 62/344
7,445,137 B2 * 11/2008 Noh et al. ..... 222/477
7,587,910 B2 * 9/2009 Bowen et al. ..... 62/389
7,617,698 B2 * 11/2009 Bowen et al. ..... 62/264
7,628,032 B2 * 12/2009 Lee et al. ..... 62/344
7,703,297 B2 * 4/2010 Bowen et al. ..... 62/344
2007/0256442 A1 11/2007 Lyvers et al.

* cited by examiner

*Primary Examiner* — Christopher Kim
(74) *Attorney, Agent, or Firm* — Robert R. Deleault, Esq; Mesmer & Deleault, PLLC

(57) ABSTRACT

An ice flap device (10) for a refrigerator comprises a flap unit (14) movable between an open position and a closed position, which unit releases a dispenser aperture for dispensing ice in its open position and blocks the dispenser aperture against dispensing ice in its closed position, as well as a motorized drive mechanism for driving the flap unit (14) between its open and closed position. According to the invention the drive mechanism comprises an a.c. motor (12) as well as a first electrical switch (26), which lies in the supply circuit of the a.c. motor and switches depending on the introduction of a receptacle into an ice dispenser compartment of the refrigerator, and by means of which the a.c. motor (12) can be turned on when the receptacle is introduced into the ice dispenser compartment for a movement of the flap unit (14) from the closed position in the direction of the open position.

11 Claims, 13 Drawing Sheets

ICE FLAP DEVICE FOR A REFRIGERATOR

Figure 1:
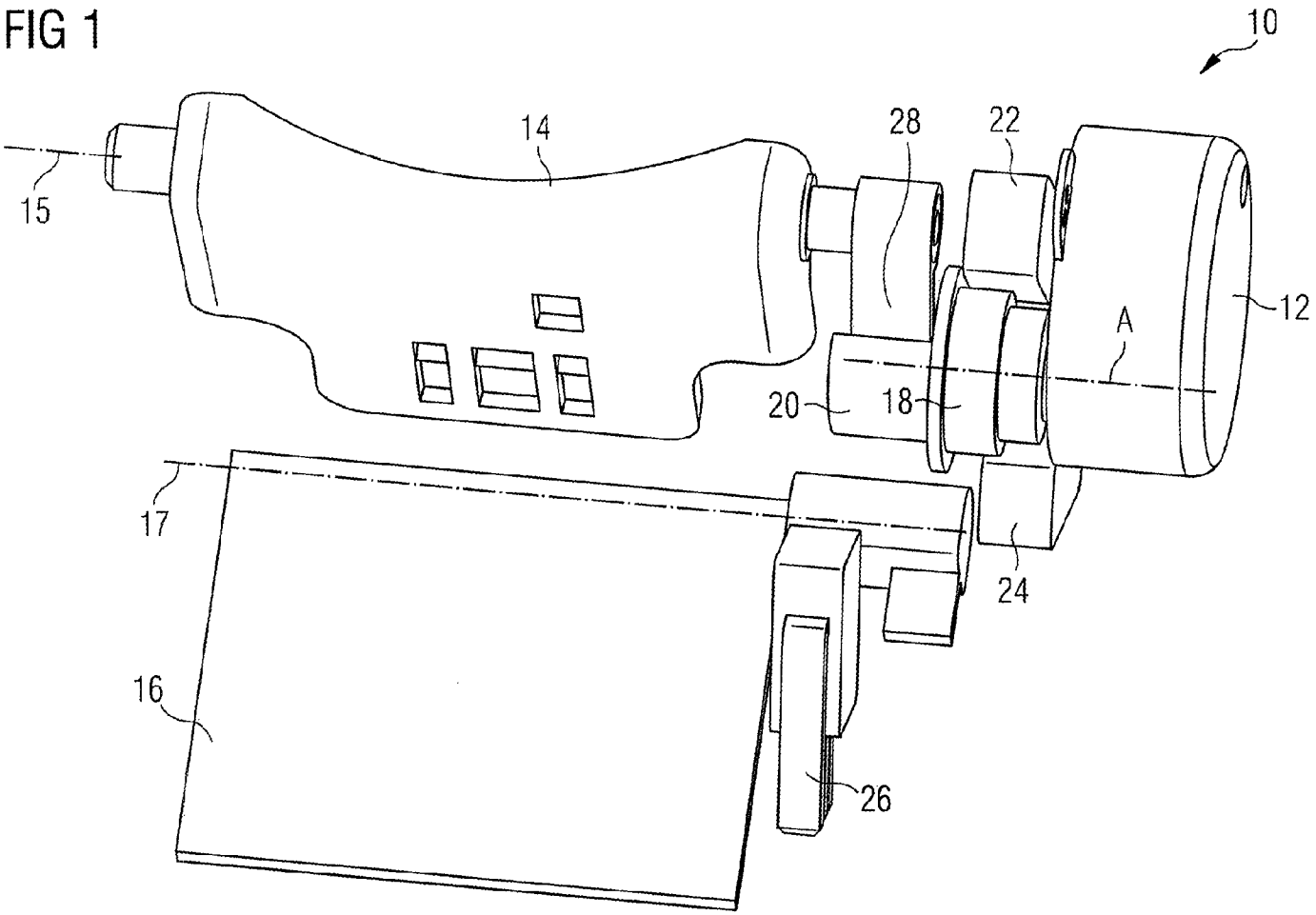

The present invention relates to an ice flap device for a refrigerator, comprising a flap unit, which is movable between an open position and a closed position and which in its open position releases a dispenser aperture for dispensing ice and in its closed position blocks the dispenser aperture from dispensing ice, and a motorised drive mechanism for driving the flap unit between its open and closed position.

Refrigerators are known that have a built-in ice dispenser for dispensing ice cubes and/or crushed ice. A compartment is normally located on the front of a door of the refrigerator for introducing a glass or other receptacle, which is to be filled with ice. Located above the glass introduced into the compartment is the end of a dispenser shaft, through which the ice falls into the glass. Depending on its position, a movable ice flap opens or closes a dispenser aperture of the dispenser shaft. The invention is concerned in particular with the operation of such an ice flap and proposes an advantageous motorized type of operation.

The object of the invention is to provide an ice flap device of the type described at the beginning, which can be manufactured cheaply with a simple design configurtion and at the same time generates little noise in operation.

To achieve this object, the invention proposes according to one aspect that in the case of a generic ice flap device, the drive mechanism comprises an a.c. motor and a first electrical switch, which lies in the supply circuit of the a.c. motor and switches depending on a user action such as the placing of a receptacle into an ice dispenser compartment of the refrigerator, for example, and by means of which the a.c. motor can be turned on when the receptacle is placed into the ice dispenser compartment to move the flap unit from the closed position in the direction of the open position.

Advantageous developments of the invention result from the dependent sub-claims.

What is advantageous about the solution according to the invention according to the above aspect is that the a.c. motor can be operated directly using the mains operating voltage of the refrigerator. A power unit for rectifying and transforming down the mains voltage, such as would be necessary in the case of a d.c. motor or a stepper motor, can be dispensed with in this respect. Motorized drive solutions are also distinguished by a lower noise level than magnetically actuated solutions, for example; they can be kept largely free of disturbing humming and clicking noises. By controlling the a.c. motor by electrical switches, which lie in the supply circuit of the motor and switch depending on the proper introduction of a receptacle into the ice dispenser compartment and/or depending on the position of the flap unit, it is also possible to dispense with complex processor-based control logic for the motor.

The user action by means of which the first switch is switched can also include, alternatively or in addition to introducing a glass into the ice dispenser compartment, pressing a button for example, by means of which the user can initiate ice dispensing and if applicable terminate it (by releasing the button or pressing it again).

According to a further aspect of the invention, furthermore, instead of an a.c. motor a d.c. motor can also be used, which can likewise be controlled by means of one or more mechanically actuatable electrical switches lying in the supply circuit of the motor. Even such a switch-controlled d.c. motor solution can manage without central control intelligence in the form of a processor for controlling the motor.

Figure 2B:
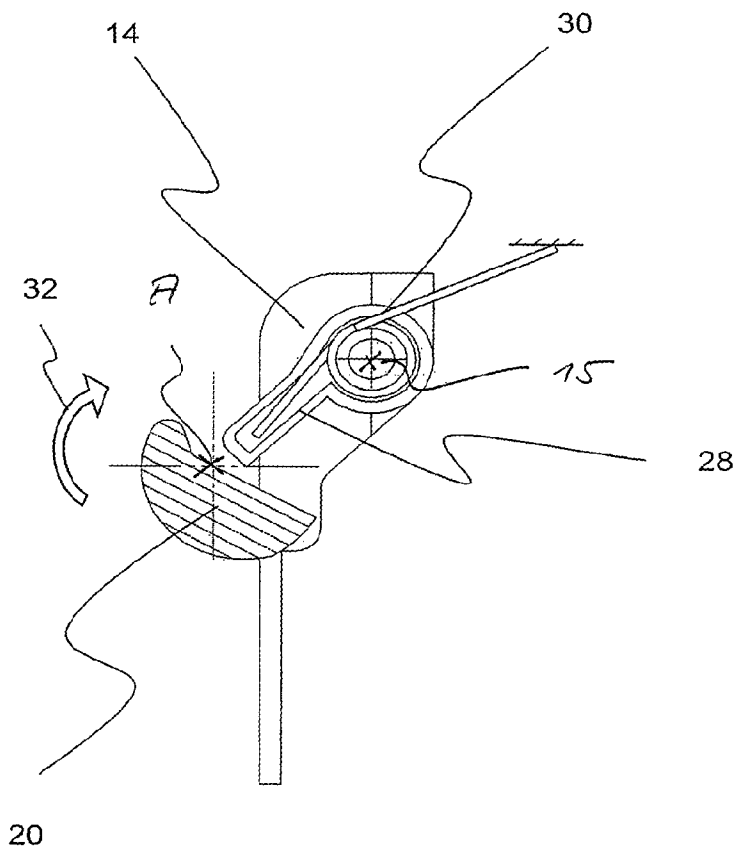
Figure 2A:
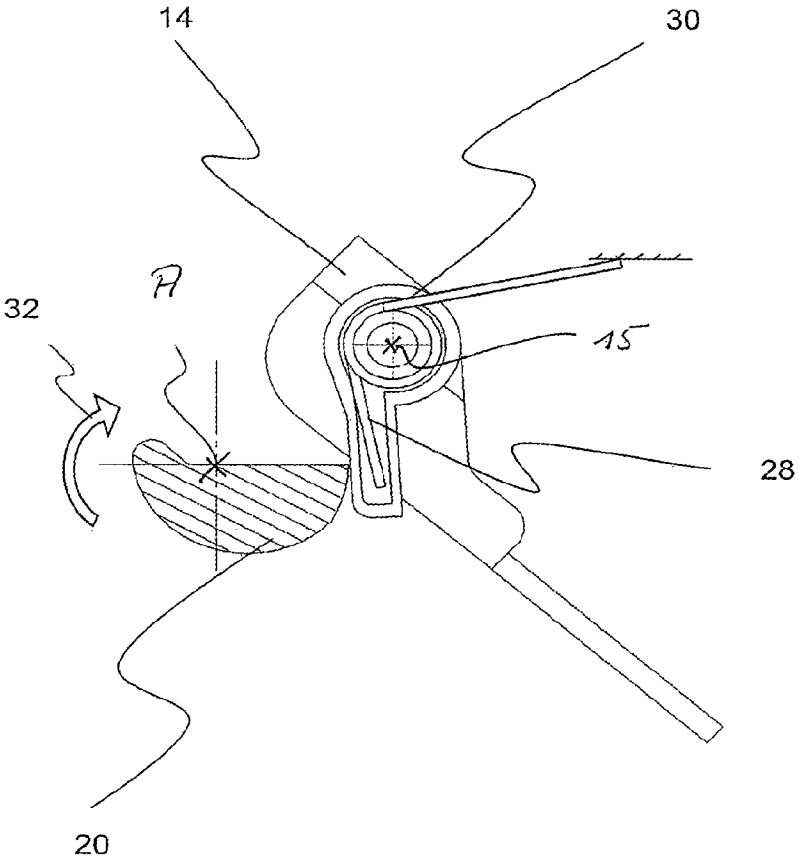
Figure 3:
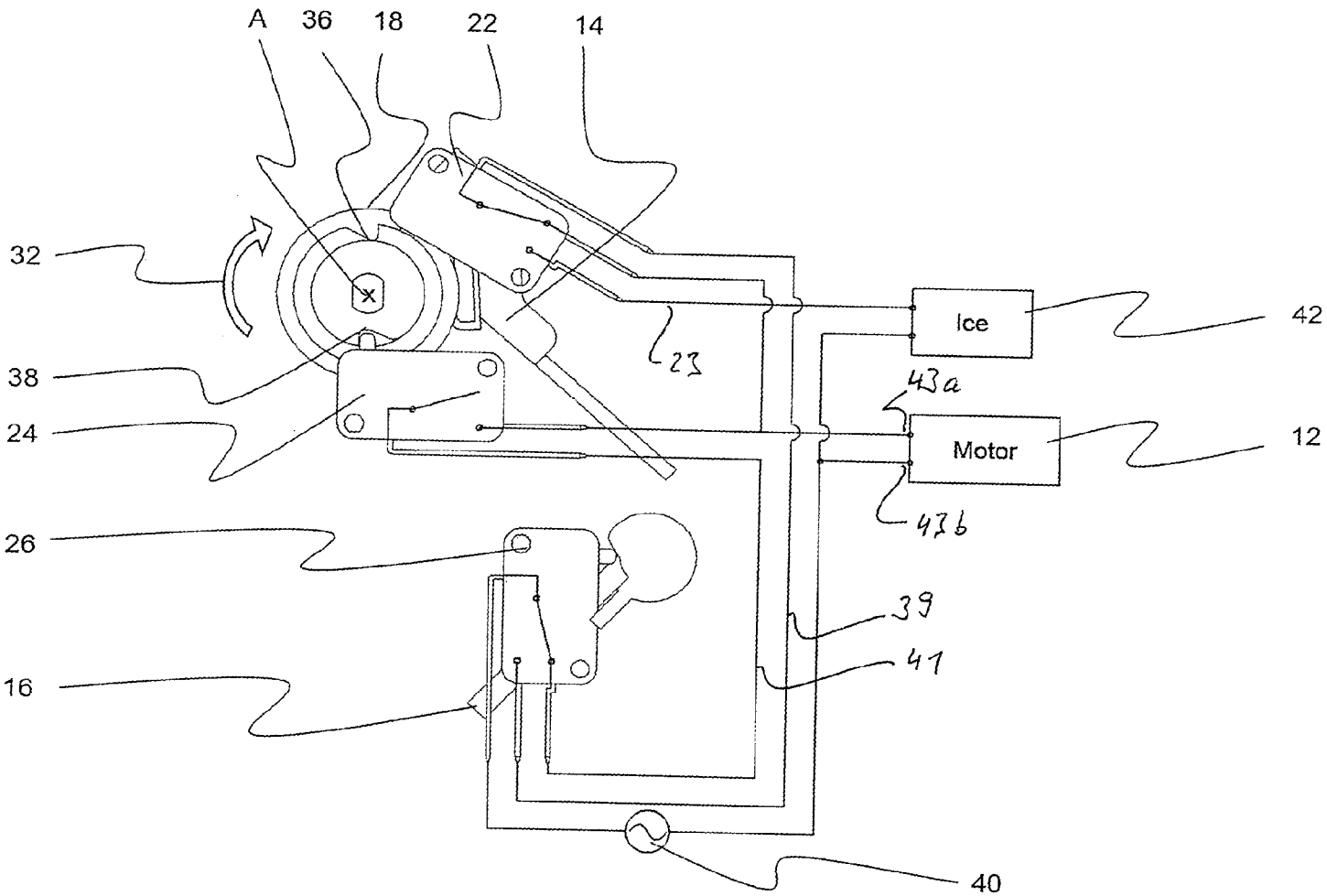
Figure 4:
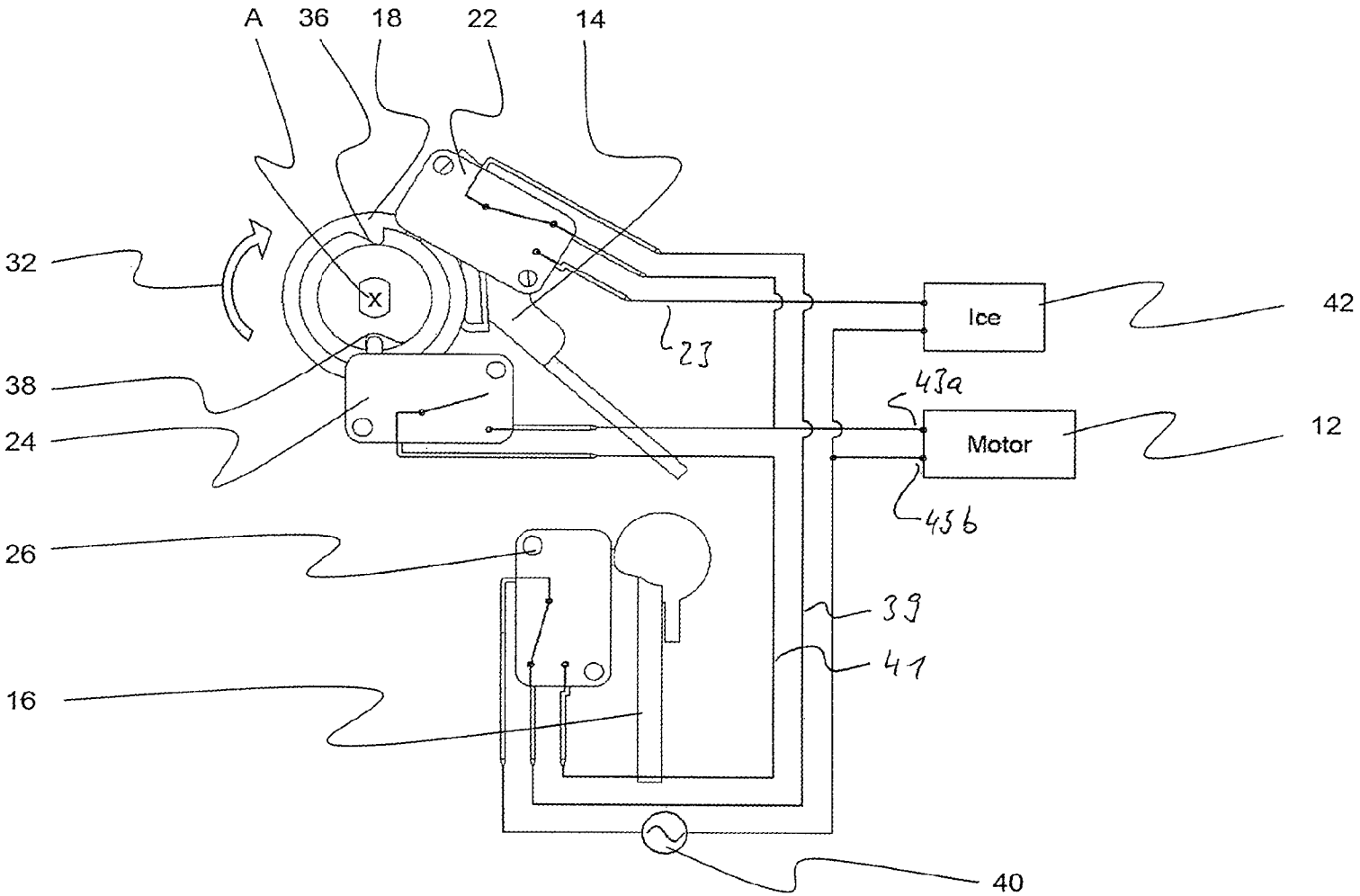
Figure 5:
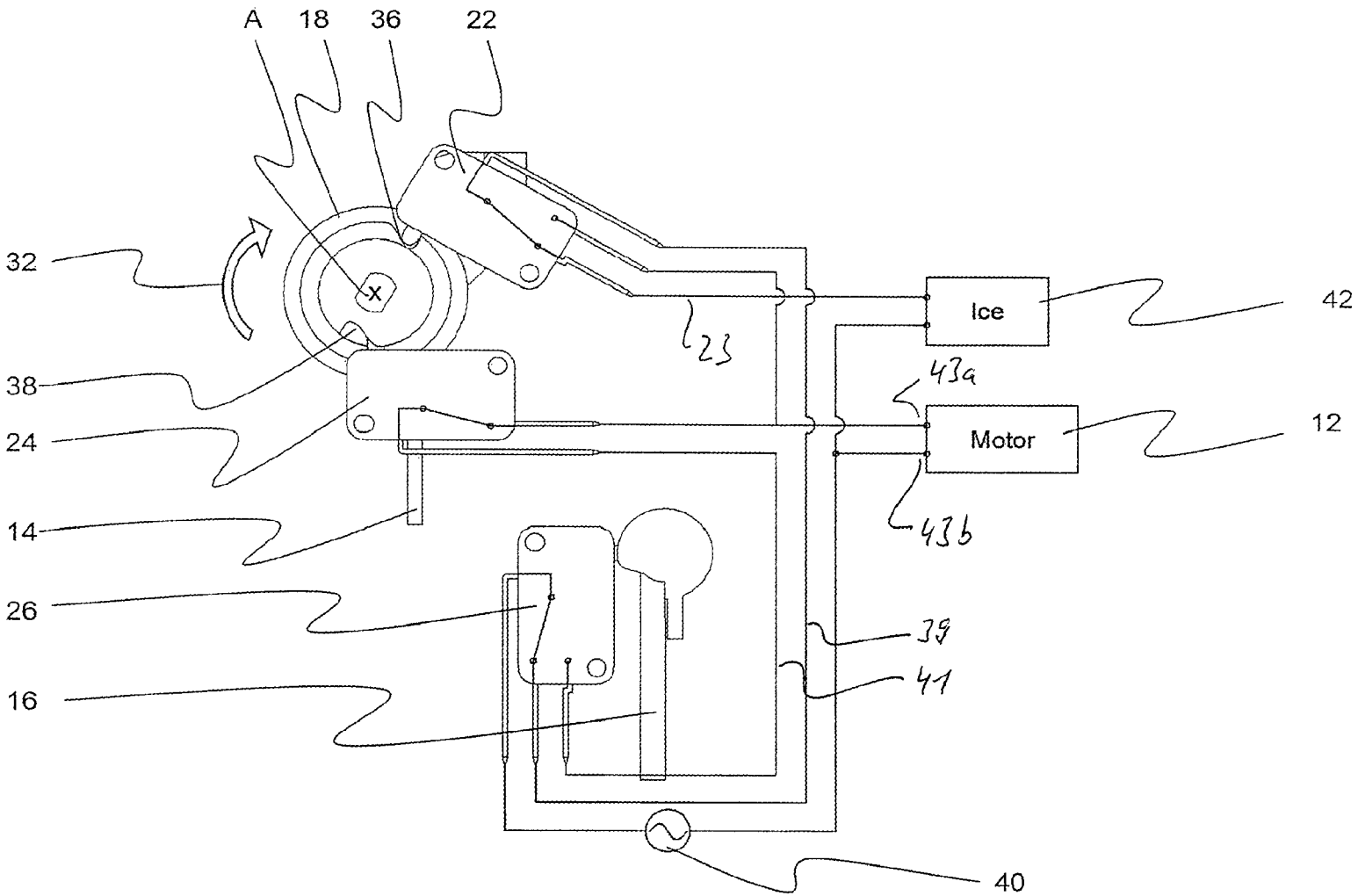
Figure 6:
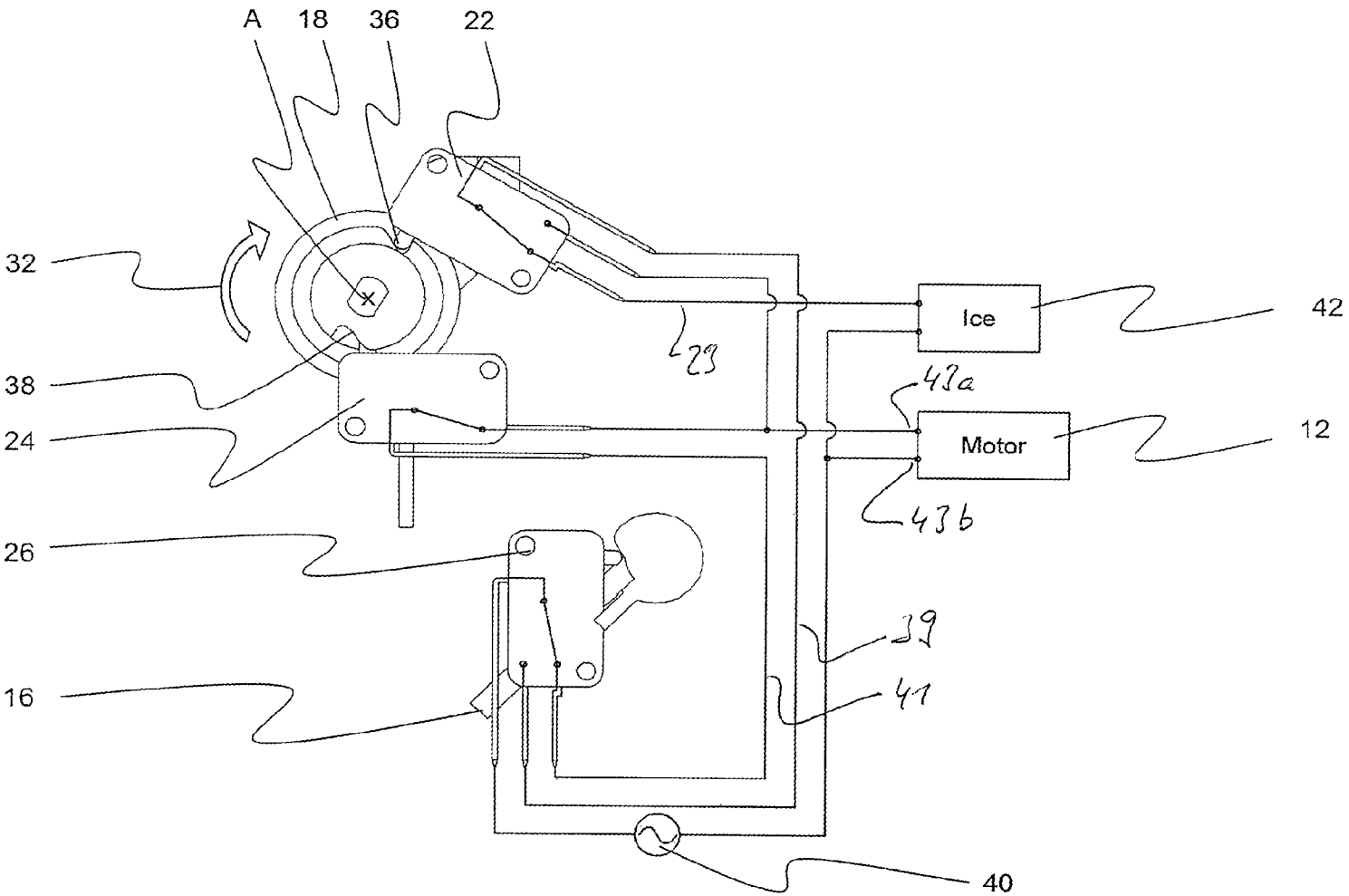
Figure 7:
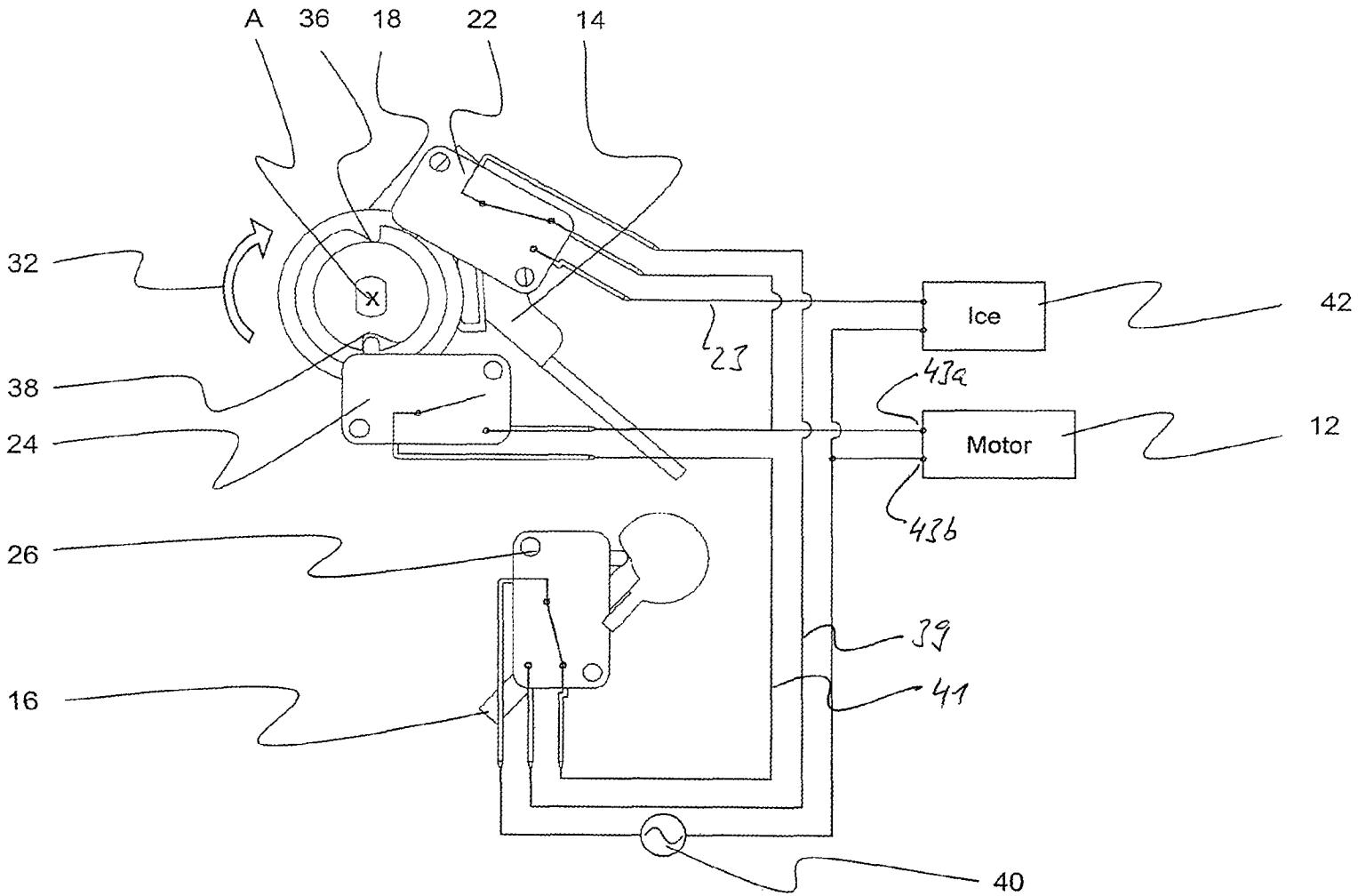
Figure 8:
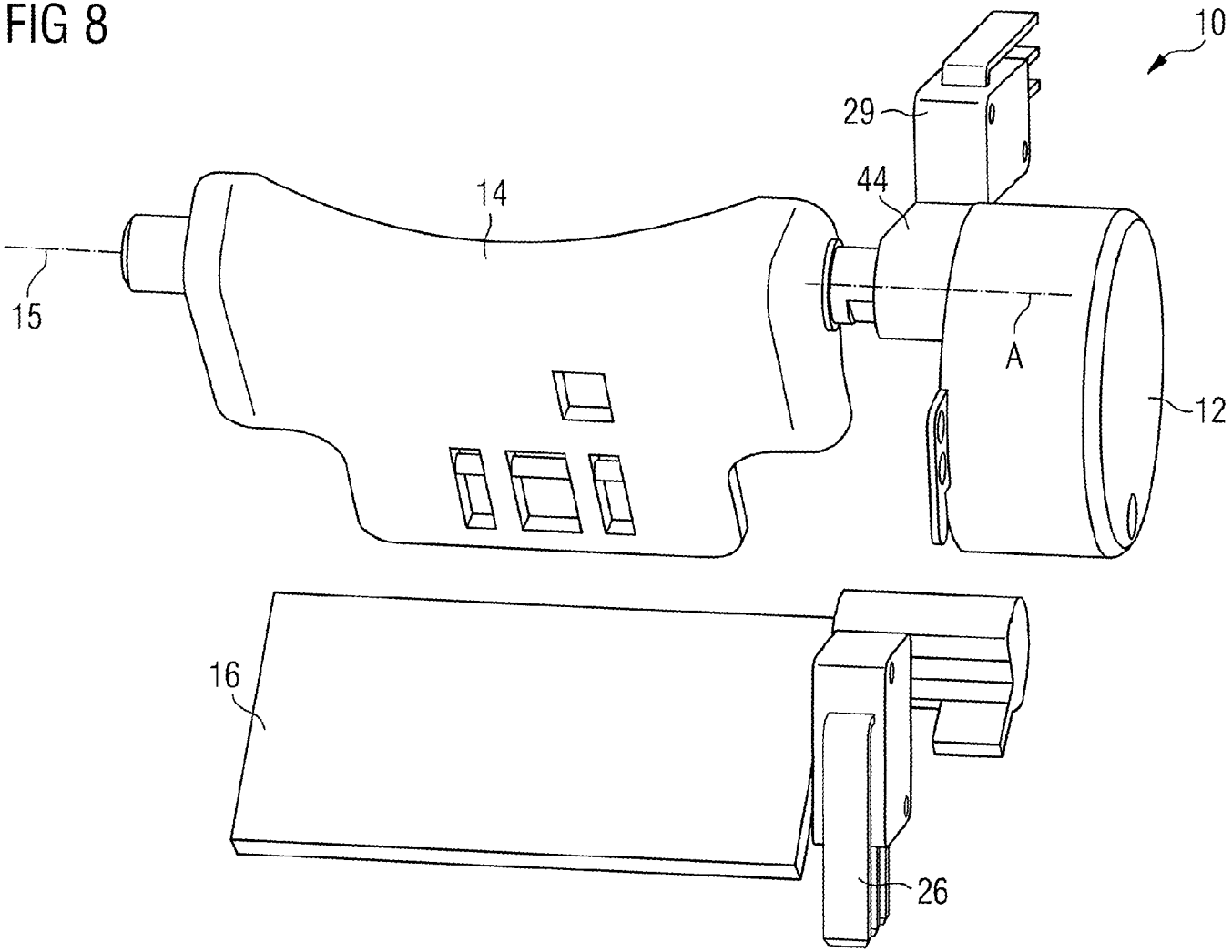
Figure 9:
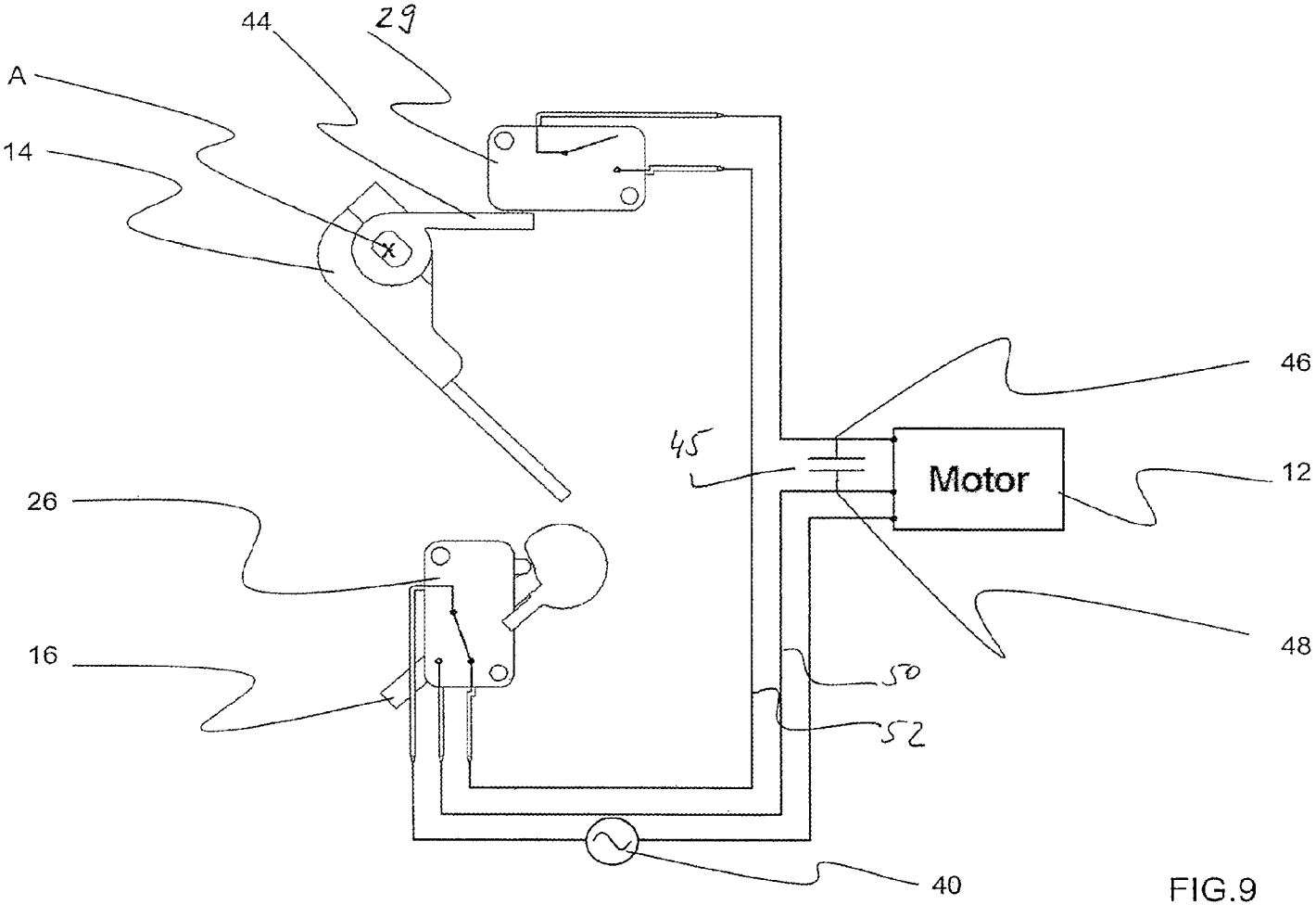
Figure 10:
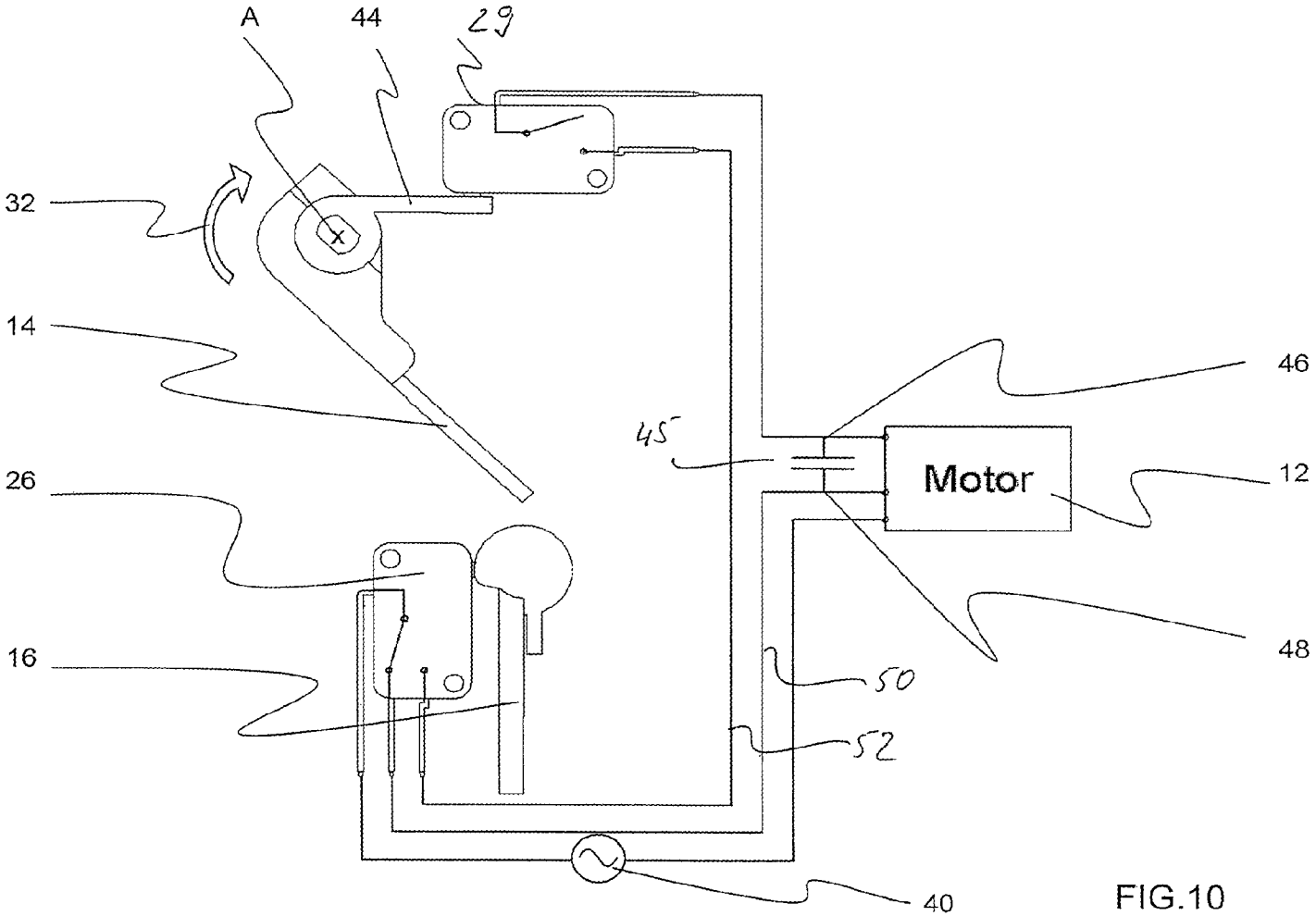
Figure 11:
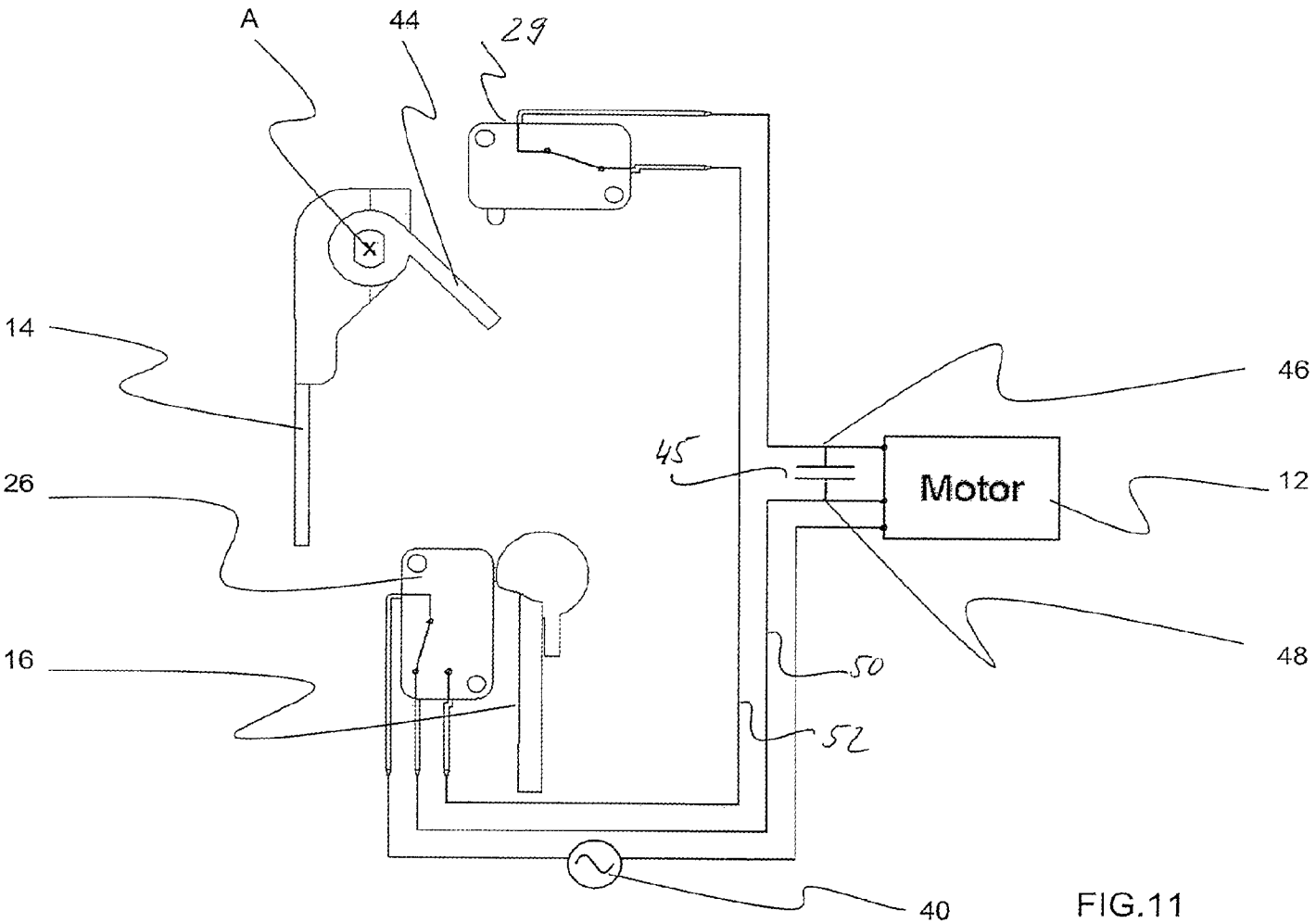
Figure 12:
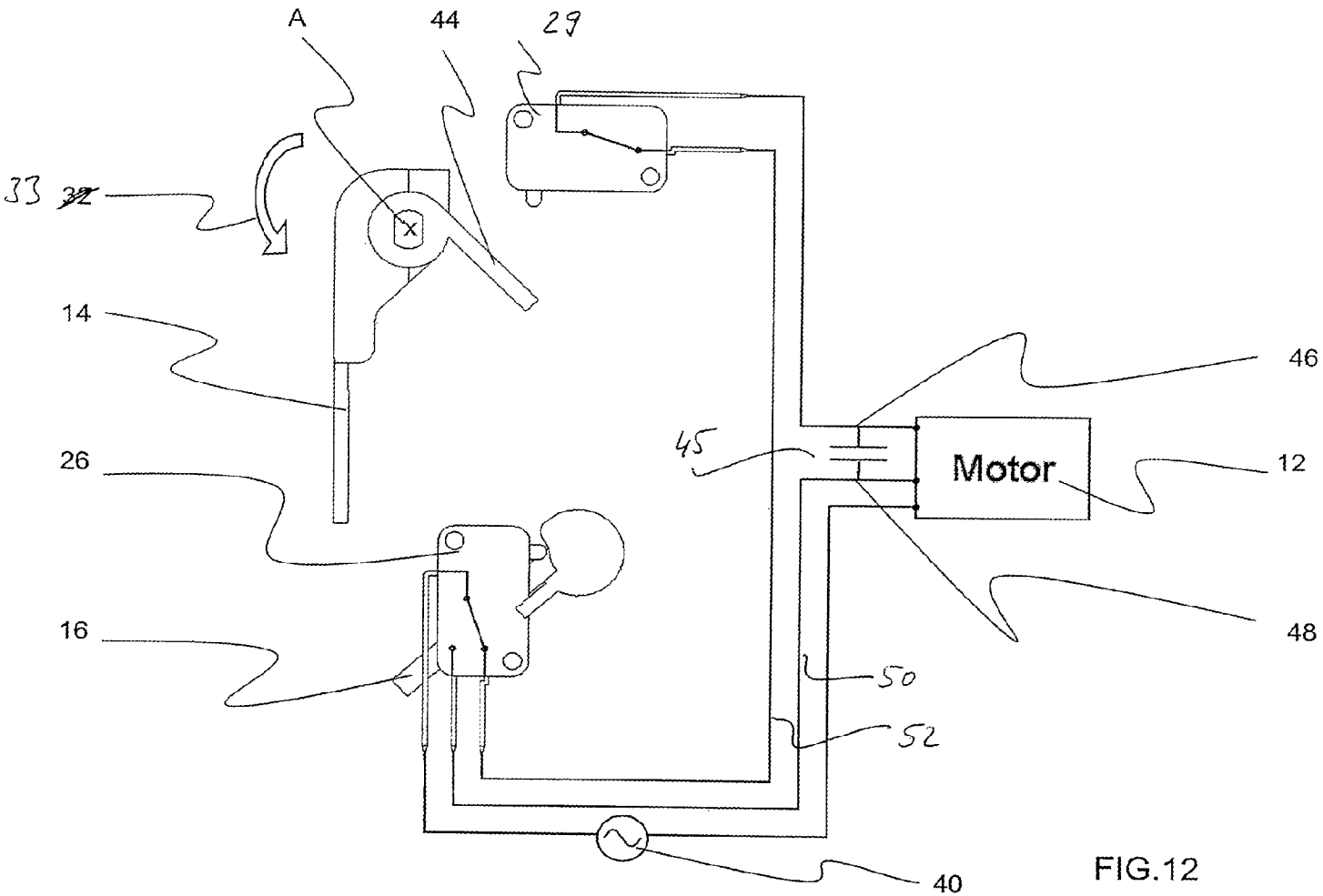
Figure 13:
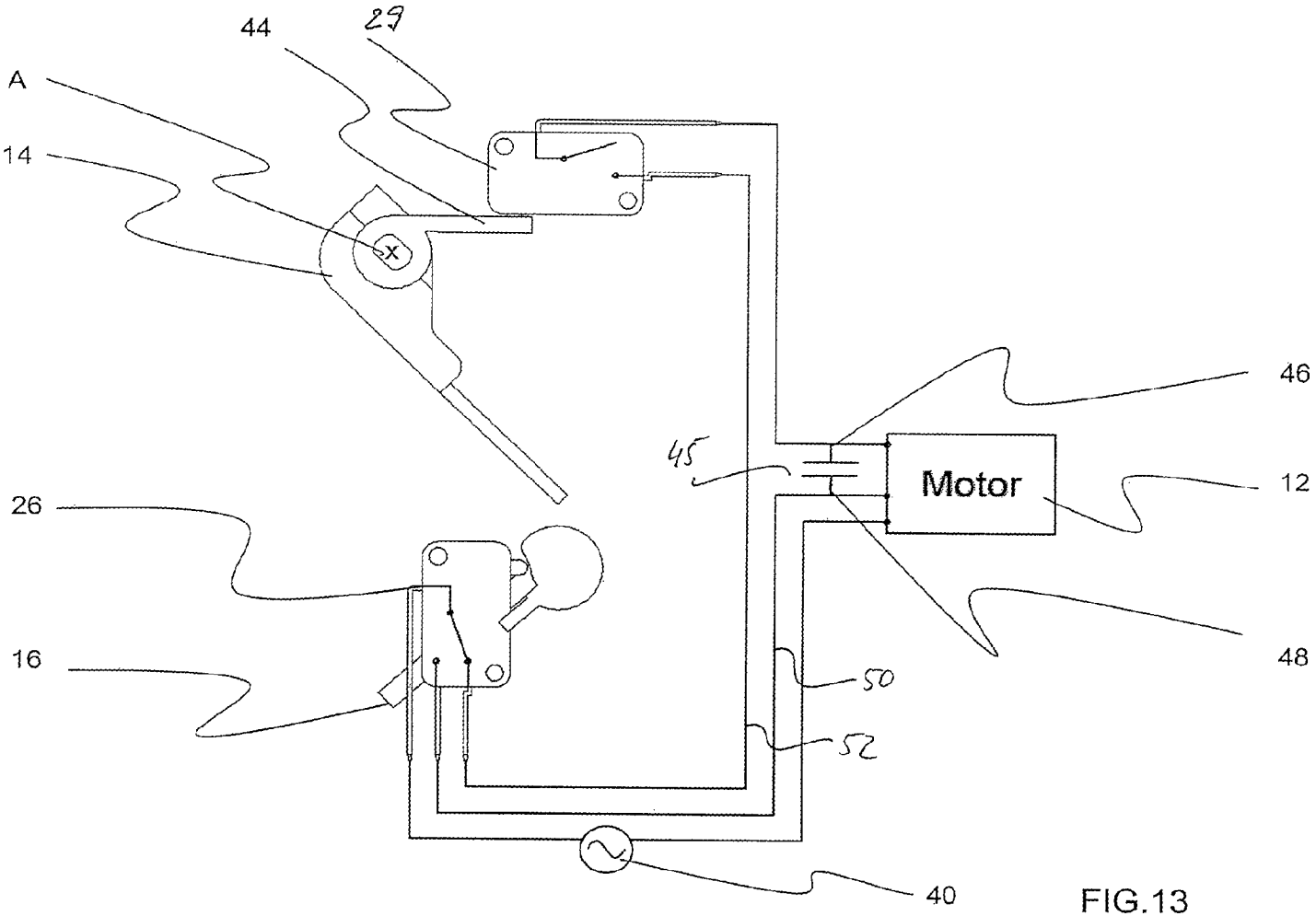

The invention is explained further below with reference to the enclosed figures. The figures show:

FIG. 1 shows components of a first embodiment of an ice flap device for a refrigerator in perspective, FIGS. 2A and 2B show an eccentric mechanism for operating an ice flap in the first embodiment, FIG. 3 shows a circuit diagram of the first embodiment in a starting position, FIG. 4 shows a circuit diagram of the first embodiment after a receptacle has been placed properly into a dispenser compartment of the refrigerator, FIG. 5 shows a circuit diagram of the first embodiment following opening of the ice flap, FIG. 6 shows a circuit diagram of the first embodiment following removal of the receptacle from the dispenser compartment, FIG. 7 shows a circuit diagram of the first embodiment following closing of the ice flap, FIG. 8 shows components of a second embodiment of an ice flap device for a refrigerator in perspective, FIG. 9 shows a circuit diagram of the second embodiment in a starting position, FIG. 10 shows a circuit diagram of the second embodiment after a receptacle has been placed properly into a dispenser compartment of the refrigerator, FIG. 11 shows a circuit diagram of the second embodiment following opening of the ice flap, FIG. 12 shows a circuit diagram of the second embodiment following removal of the receptacle from the dispenser compartment, FIG. 13 shows a circuit diagram of the second embodiment following closing of the ice flap.

To explain the ice flap device according to the first embodiment, reference is made first to FIG. 1. The ice flap device shown there and generally designated 10 comprises a drive motor unit 12 formed as an a.c. motor for driving a flap unit 14 between an open and a closed position. Only one flap carrier of the flap unit 14 is shown in FIG. 1, to which carrier a dispenser flap formed for example as a rubber panel is attached fixedly or with some movement tolerance in a manner that is known in itself but not shown more closely here. This dispenser flap is used for the preferably substantially air-tight closure of a dispenser aperture, through which ice cubes produced inside the refrigerator can fall from a dispenser shaft into a receptacle placed by a user into an ice dispenser compartment. The flap unit 14 is held on a dispenser housing, which is not shown in greater detail, swivellably about a swivel axis 15 between an open position and a closed position. In the closed position it closes said dispenser aperture, while in the open position it releases the dispenser aperture.

The flap unit 14 is pretensioned by spring pretensioning means, in the case of the example by a torsion spring 30 (see FIG. 2A, 2B), in one of its two positions, for example in its open position.

Protruding into said dispenser compartment of the refrigerator is an operating rocker 16, which is supported swivellably about an axis of rotation 17 and is pushed backwards (relative to the dispenser compartment) against the resetting effect of an elastic pretensioning element (not shown in greater detail) by the receptacle when this is placed in the dispenser compartment. The operating rocker 16 tilting backwards thereupon mechanically actuates a first electrical switch 26, the switching of which turns on the motor 12. If the receptacle is removed from the dispenser compartment again, the operating rocker 16 swivels back, at which the switch 26 switches back to its original position. The switch 26 thus switches depending on the placing of the receptacle into the dispenser compartment. It goes without saying that solutions other than an operating rocker are possible to actuate an electrical switch depending on the placing of a receptacle into the ice dispenser compartment of the refrigerator. For example, a pressure switch, which is actuated directly by the receptacle, could be provided at the rear end of the dispenser compartment.

Connected to the motor shaft of the motor 12 is a cam disc 18, which rotates about the axis designated A of the motor 12 when the motor 12 is driven. The external circumferential face of the cam disc 18 serves as a control face for controlling two further mechanically actuated electrical switches 22, 24. Furthermore, protruding axially from the cam disc 18 is an eccentric lug or cam 20 circulating with the disc around the axis A, which cam interacts with the flap unit 14 to drive it. Specifically the eccentric lug 20 interacts in the example shown with a radial finger 28 of the flap unit 14, which finger is formed in an axially lateral area of the flap carrier and preferably in one piece with this.

The motor axis A and the flap swivel axis 15 lie substantially parallel to one another but at a radial distance from one another. The circulatory path of the eccentric lug 20 runs partly through the swivel space of the flap unit 14 and partly outside this. Accordingly no permanent coupling exists between the motor 12 and the flap unit 14. Instead of this, when the motor 12 is driven, the eccentric lug 20 moves from outside the swivel space of the flap unit 14 towards it until it abuts against the finger 28. When the motor 12 rotates further in the same direction of rotation, the eccentric lug 20 then presses the flap unit 14 open or closed against the effect of the torsion spring 30 depending on whether the flap unit is pretensioned in its closed position or its open position. As the motor 12 rotates still further in the same direction of rotation, the eccentric lug 20 then moves through a dead centre of maximum opening or maximum closing of the flap unit 14 and again approaches the limit at which it exits the swivel space of the flap unit 14. In this phase, the flap unit 14 closes or opens again under the pretensioning effect of the torsion spring 30, until it finally comes to rest in its closed position or open position by stopping at an abutment that is stationary relative to the dispenser housing and the eccentric lug 20 exits the swivel space of the flap unit 14.

A complete revolution of the eccentric lug 20 thus corresponds to an opening and subsequent closing of the flap unit 14. The motor 12 can always be operated in the same direction of rotation in this case.

FIGS. 2A and 2B better clarify the drive coupling between motor 12 and flap unit 14 explained above. FIG. 2A shows the flap unit 14 in its closed position, while FIG. 2B shows the open position of the flap unit 14. In the closed position according to FIG. 2A, the eccentric cam 20 presses against the finger 28 of the flap unit 14 opposing the force action of the torsion spring 30. If the operating rocker 16 is now actuated and the motor 12 turned on, the eccentric cam 20 rotates in the direction of the arrow 32 about the motor axis A. The eccentric cam 20 gradually releases the finger 28 in this case, so that the latter can move into its open position according to FIG. 2B due to the pretensioning effect of the torsion spring 30.

To close the flap unit 14, the motor 12 is rotated further in the direction of the arrow 32. The eccentric cam 20 then rotates out of the rotary position according to FIG. 2B in the arrow direction 32 until it encounters the finger 28 again and subsequently closes the flap unit 14 again.

It can be seen that the angle of rotation of the eccentric cam 20 from the closed position of the flap unit 14 according to FIG. 2A to the open position according to FIG. 2B is considerably smaller than the angle of rotation that the eccentric cam 20 must then cover to close the flap unit 14 again. In other words, a comparatively short activation of the motor 12 is sufficient to open the flap unit 14. The user only has to put up with a short delay, therefore, before ice cubes can be dispensed after the insertion of a glass into the dispenser compartment.

The two further switches 22, 24 likewise lie in the supply circuit of the motor 12. They each have one actuating finger in permanent spring-loaded engagement with the control face formed on the outer circumference of the cam disc 18, so that the actuating fingers follow the radial contour of the control face. The switching state of the switches 22, 24 depends in this manner on the rotary position of the cam disc 18 and accordingly on the rotary position of the motor shaft.

To explain in greater detail the electrical interconnection of the switches 22, 24, 26 and the motor 12 and the control of the ice flap device 10 depending on the switching states of the switches, reference is now made to FIGS. 3 to 7.

FIG. 3 shows the ice flap device 10 in a starting or resting position, in which the operating rocker 16 is not actuated and the flap unit 14 is in its closed position. It can be seen that the cam disc 18 has two radial control notches 36, 38 lying at a distance from one another in a circumferential direction, but that otherwise it has a substantially constant radial height. The control notches 36, 38 cause a changeover of the switches 22, 24 if their actuating fingers fall or dip into one of the notches respectively.

The switch 26 is a two-way switch, which depending on the switching state applies an a.c. mains voltage 40 (e.g. 110 V or 220/240 V) serving as a supply voltage to one of two parallel circuit branches 39, 41, which both run electrically parallel to one another and lead to a common first voltage connection 43*a* of the motor 12. The circuit branch 39 runs via the further switch 22, while the circuit branch 41 runs via the further switch 24.

The switch 22 is likewise formed as a two-way switch. Depending on the switching state, it either closes the circuit branch 39 (as e.g. in FIG. 3) or it connects its input connection to a current path 23, which leads to one of two operating voltage connections of a drive unit 42 for an ice cube feed.

The switch 24 is formed as a simple on/off switch, which opens the circuit branch 41 (as e.g. in FIG. 3) or closes it depending on the switching state.

A second voltage connection 43*b* of the motor 12 is connected directly to the supply voltage 40. The same applies to the other operating voltage connection of the drive unit 42.

In the starting state of the ice flap device 10 according to FIG. 3, the first switch 26 is switched to the circuit branch 41. The switch 24 is open in the starting situation, however, for which reason the circuit branch 41 is open and no current flow takes place to the motor 12. The circuit branch 41 is closed in contrast by the switch 22.

FIG. 4 shows the situation after the user has placed a receptacle into the dispenser compartment and has consequently changed over the switch 26. The switch 26 is now switched to the circuit branch 39 (already closed by the switch 22), so that a flow of current can take place to the motor 12. The supply of current to the motor 12 drives this and with it the cam disc 18 around the motor axis A in the direction of the arrow 32. At the same time, the eccentric cam 20 moves away from the finger 28 of the flap unit 14, so that the flap unit 14 opens.

As a result of the rotation of the cam disc 18, both switches 22, 24 are actuated. The situation according to FIG. 5 arises. The switch 24 and with it the circuit branch 41 are now closed, while the switch 22 is switched to the path 23. The switching of switch 22 opens the motor circuit, hence the motor 12 stops. Instead the drive unit 42 is now supplied with current via the switch 22, ensuring a feed of ice cubes, which are available in a suitable storage box inside the refrigerator. The drive unit 42 can likewise comprise, for example, an a.c. motor that can be operated directly from the mains voltage. The ice cubes that are fed forward enter the dispenser shaft and fall through the dispenser aperture, which is now open, into the glass that has been introduced. Ice cubes are delivered until the user withdraws his glass from the dispenser compartment. The operating rocker 16 can then swivel back and the first switch 26 can switch back again to the circuit branch 41. This interrupts the supply of current to the drive unit 42. The situation according to FIG. 6 arises.

In FIG. 6, the motor circuit is closed via the circuit branch 41, causing the motor 12 to be driven again. The cam disc 18 and the eccentric cam 20 move with it in the direction of the arrow 32. The motor 12 is active until the cam disc 18 opens the switch 24 and so interrupts the motor circuit. In the meantime, the flap unit 14 closes again. Eventually the state according to FIG. 7 arises, which corresponds to the starting state according to FIG. 3. The cam disc 18 has rotated in FIG. 7 by a full revolution in the arrow direction 32 compared with FIG. 3.

When the flap unit 14 opens (phase between FIGS. 4 and 5), the switch 24 must switch together with the switch 22 at the latest. Otherwise the switch 24 would not be prepared for the subsequent closing of the flap unit 14, where it must be closed. To this end it can be expedient if the switch 24 even switches shortly before the switch 22.

When the flap unit 14 closes (phase between FIGS. 6 and 7), the switch 22 switches back to the circuit branch 39 shortly after the start of the closing process and hereby closes this branch. The feed of ice cubes is quickly turned off in this way. At the same time, the circuit branch 39 is thus already prepared if the user should inadvertently operate the operating rocker 16 once more with the glass during the closing process. The motor current could then flow via the switch 22 and the circuit branch 39 and the closing process of the flap unit 14 could nevertheless be continued and completed. An undesirable open position of the flap unit due to an operating error by the user can thus be excluded.

The time profile indicated for the switching processes of the switches 22, 24 can be set without difficulty via the opposite angular position of the notches 36, 38 and their angular extension as well as via the opposite angular position of the switches 22, 24. In the example shown, the notches 36, 38 are arranged for this purpose approximately at a distance of 180 degrees from one another, whereas the switches 22, 24 are arranged at a somewhat smaller effective angular distance from one another.

To explain the second embodiment, reference is made below to FIGS. 8 to 13. Identical components or components with the same effect are designated there by the same reference signs as before.

The ice flap device 10 according to the second embodiment differs from the previous embodiment essentially in that the a.c. motor 12 is a polyphase motor operable in both directions of rotation and in particular a capacitor motor, which has a permanent rotary drive connection to the flap unit 14, preferably on the same axis, and in that in addition to the first switch 26 only one further switch 27 lies in the supply circuit of the motor 12. The switching state of this switch 27 is also dependent directly on the rotary position of the flap unit 14 due to the fixed drive coupling between motor 12 and flap unit 14.

In FIG. 8 it can be seen that the flap unit 14 has a radial switching finger 44 axially to the side, which interacts with the switch 29 and sets this to one of two switching states depending on the rotary position of the flap unit 14.

The motor 12 operates with at least two phase voltages, the relative phase position of which determines the direction of rotation of the motor 12. In particular, the motor 12 produces by means of a capacitor arrangement an auxiliary phase voltage from an available single-phase mains voltage, wherein the switching states of the two switches 26, 29 determine the relative phase position (leading, lagging) of the auxiliary phase voltage thus generated compared with the mains voltage serving as an operating phase voltage. The capacitor arrangement, which can consist for example of a single capacitor, is designated 45 in FIGS. 9 to 13.

FIG. 9 shows the circuit diagram of the second embodiment in a resting or starting position, in which the operating rocker 16 is not actuated and the flap unit 14 is in its closed position. It can be seen that the first switch 26, as in the first embodiment, is a two-way switch, while the further switch 29 is an on/off switch. Depending on its switching state, the two-way switch 26 connects the mains voltage 40 to one of two circuit branches 50, 52, which each lead to a capacitor connection 48 and 46 respectively. The switch 29 lies in one of the circuit branches 50, 52, in this case the circuit branch 52. In the starting situation, the switch 26 is switched to the circuit branch 52, wherein the switch 29 is open and accordingly no current flows to the circuit branch 52.

If the operating rocker 16 is actuated by introducing a receptacle into the dispenser compartment (FIG. 10), the switch 26 switches over to the circuit branch 50. This closes the circuit to the capacitor connection 48, whereupon the motor 12 is operated in a first direction of rotation (shown by the rotary arrow 32). In this first direction of rotation the flap unit 14 is opened. When the flap unit 14 opens, the switching finger 44 releases the switch 29, which causes this to switch over and closes the circuit branch 52. FIG. 11 shows this state. During opening the flap unit 14 runs against a stop, which is not shown in greater detail, and is thereby brought to a halt. The motor 12 can be disconnected in this case from a further supply of current by a further switch, which is not shown in greater detail and which responds to the stopping of the flap unit 14.

In the situation according to FIG. 11, as soon as the user removes his glass from the dispenser compartment and the operating rocker 16 can swivel back accordingly, the switch 26 is switched to the—now closed—circuit branch 52 (FIG. 12). This closes the circuit to the capacitor connection 46, which leads to operation of the motor in the opposite direction of rotation (shown by a rotary arrow 33). The flap unit 14 is thereby closed. On closing it eventually abuts with its switching finger 44 against the actuating pin of the switch 29 and so causes the switch 29 to open and the motor 12 to stop. The state according to FIG. 13 arises, which corresponds to the starting state according to FIG. 9.

In FIGS. 9 to 13 no drive unit for the ice cube feed has been drawn in. Such a drive unit can easily be supplied with power likewise from the mains voltage 40 and activated and deactivated depending on the switching state of the switches 26, 29. It may possibly be necessary to insert at least one further switch for controlling this feed drive unit into the supply circuit of the motor 12, wherein the switching state of this at least one further switch is determined by the position of the flap unit 14 and/or one or more other mechanical components of the ice flap device.

The invention claimed is:

1. Ice flap device for a refrigerator, comprising a flap unit movable between an open position and a closed position, the flap unit releasing a dispenser aperture for dispensing ice in its open position and blocking the dispenser aperture against dispensing ice in its closed position;

a motorized drive mechanism for driving the flap unit between the open and closed position thereof, the drive mechanism including an a.c. motor and a first electrical switch disposed in a supply circuit of the a.c. motor and switching depending on a user action, wherein the first electrical switch permits the a.c. motor to be turned on in response to the user action for a movement of the flap unit from the closed position in the direction of the open position;

wherein at least one further electrical switch is disposed in the supply circuit of the a.c. motor; and wherein the a.c. motor is a polyphase motor operable in both directions of rotation, in which the relative phase position of at least two phase voltages is dependent on the switching state of at least one of the switches.

2. Ice flap device according to claim 1 wherein the a.c. motor is a capacitor motor, which produces an auxiliary phase voltage from a single-phase supply voltage by means of a capacitor arrangement.

3. Ice flap device according to claim 2, wherein the first switch is a two-way switch, which depending on its switching position connects the supply voltage to one of two circuit branches, which each lead to a capacitor connection of the a.c. motor.

4. Ice flap device according to claim 3, wherein in that the further switch is disposed in one of the two circuit branches leading to the capacitor connections of the a.c. motor and closes this circuit branch depending on the flap unit departing from its closed position towards the open position.

5. Ice flap device according to claim 1, wherein the a.c. motor is a two-phase motor.

6. Ice flap device according to claim 1, wherein a mains operating voltage of the refrigerator serves as supply circuit.

7. Ice flap device according to claim 1, wherein the user action includes a user introducing a receptacle into an ice dispenser compartment of the refrigerator.

8. Ice flap device for a refrigerator comprising:

a flap unit movable between an open position and a closed position, the flap unit releasing a dispenser aperture for dispensing ice in its open position and blocking the dispenser aperture against dispensing ice in its closed position;

a motorized drive mechanism for driving the flap unit between the open and closed position thereof, the drive mechanism including an a.c. motor and a first electrical switch disposed in a supply circuit of the a.c. motor and switching depending on a user action, wherein the first electrical switch permits the a.c. motor to be turned on in response to the user action for a movement of the flap unit from the closed position towards the open position;

a drive coupling mechanism acting between the flap unit and the a.c. motor to permit rotation of the a.c. motor in the same direction of rotation both to move the flap unit from the closed position to the open position and vice-versa;

wherein the first switch is a two-way switch, which depending on its switching position connects the supply voltage to one of the two electrically parallel circuit branches, which both lead to a common voltage connection of the a.c. motor;

wherein a further switch is disposed in each of the two parallel circuit branches, the further switch opening and closing its associated circuit branch depending on its switching state; and wherein to move the flap unit from the closed to the open position a first of the two parallel circuit branches is closed, while the other, second circuit branch is open at least temporarily, and to move the flap unit from the open to the closed position the first circuit branch is open at least temporarily, while the second circuit branch is closed.

9. Ice flap device according to claim 8, wherein one of the two further switches is a two-way switch, which depending on its switching state connects an input connection to one of two output connections, one of which is connected to the associated circuit branch of the two parallel circuit branches and the other one of which is connected to an operating voltage connection of a drive unit for an ice cube feed.

10. Ice flap device according to claim 8, wherein a mains operating voltage of the refrigerator serves as supply circuit.

11. Ice flap device according to claim 8, wherein the user action includes a user introducing a receptacle into an ice dispenser compartment of the refrigerator.

* * * * *